US005902191A

United States Patent [19]

Masutani et al.

[11] Patent Number: 5,902,191

[45] Date of Patent: May 11, 1999

[54] GOLF BALLS AND THEIR PRODUCTION PROCESS

[75] Inventors: Yutaka Masutani; Keisuke Ihara; Hirotaka Shimosaka, all of Saitama, Japan

[73] Assignee: Bridgestone Sports Co., Ltd., Tokyo, Japan

[21] Appl. No.: 08/855,539

[22] Filed: May 13, 1997

[30] Foreign Application Priority Data

May 13, 1996 [JP] Japan ..... 8-142232

[51] Int. Cl.[6] ..... A63B 37/12; A63B 37/14

[52] U.S. Cl. ..... 473/365; 473/377; 473/378

[58] Field of Search ..... 473/378, 383, 473/384, 385, 377, 365

[56] References Cited

U.S. PATENT DOCUMENTS 3,676,387 7/1972 Lindlof ..... 473/378 X 5,730,665 3/1998 Shimosaka et al. ..... 473/383 X

*Primary Examiner*—George J. Marlo

*Attorney, Agent, or Firm*—Sughrue, Mion, Zinn, Macpeak & Seas, PLLC

[57] ABSTRACT

A golf ball has a coating layer made of a thermoplastic resin and formed by hot-melt coating at the surface portion thereof. For example, a two-piece golf ball is produced by enclosing a solid core with a cover material; conducting mark stamping directly on the surface of the cover material; forming, by hot-melt coating, a transparent coating layer made of a thermoplastic resin as an outermost layer; and then conducting dimple processing. The coating has a thickness in the range of 15–700 μm. The coating allows the dimples to be precisely shaped and sharp edged and can be given sufficient durability and functions to improve spin properties and travel properties.

11 Claims, 2 Drawing Sheets

GOLF BALLS AND THEIR PRODUCTION PROCESS

BACKGROUND OF THE INVENTION

1. Field of the Invention

The present invention relates to a golf ball having a coating layer (a layer formed by coating) at its surface portion, which allows design values to be reliably reproduced, which allows dimples to be precisely shaped and sharp edged, and which can be given sufficient durability and functions to improve spin properties and travel properties, and to a production process thereof.

2. Related Art

Multipiece golf balls, such as two-piece golf balls, three-piece golf balls, etc., and thread-wound golf balls are usually produced by a process which comprises enclosing a solid core or a thread-wound core with a cover material and forming dimples by compression or injection molding, applying a coating layer on the surface of the cover material, conducting mark stamping by a transfer printing method, and then forming an outermost layer coating of the ball. In some cases, the mark stamp may be directly applied to the cover material surface, and then an outermost layer coating may be formed. One-piece golf balls are produced by a process which comprises preparing a solid core having dimples by compression or injection molding, and then subjecting the solid core to mark stamping and application of an outermost layer coating of the ball in this order In In this case, the coating layer on the surface of the cover material and the outermost layer coating of the ball use a thermosetting coating material or a two-pack system coating material. Since coatings formed of these coating materials cannot be easily deformed by application of heat and pressure, dimples cannot be easily formed after formation of such coatings. Therefore, coating is performed after dimples are formed.

However, the above-described conventional coating formed on the cover material or outermost layer coating of a ball is formed to protect the golf ball from dirt or scratch and to improve the appearance thereof. No attempts have been made to give these coatings functions to improve spin properties and travel properties.

By contrast, the present inventors approached an idea to give a coating layer at a ball surface portion functions to improve spin properties and travel properties. In order to give the coating layer such functions, the coating layer must accordingly be made thicker. At the same time, the coating layer must have sufficient durability to maintain the functions.

However, when coating is performed after formation of dimples as conventionally practiced, the coating shallows the dimples and dulls dimple edges if formed relatively thick on dimples. This impairs preciseness of a dimple shape. Accordingly, coating thickness must be made as thin as possible in order to prevent the coating from impairing preciseness of the dimple shape. Thus, it is difficult for a coating to have a thickness such as to have sufficient durability and functions to improve spin properties and travel properties.

SUMMARY OF THE INVENTION

The present invention was made in view of the above problems, and has the object of providing a golf ball whose coating layer at the surface portion, even when formed relatively thick, allows dimples to be precisely shaped and sharp edged and can be given sufficient durability and functions to improve spin properties and travel properties, and a production process thereof.

To achieve the above object, the present invention provides a golf ball comprising a thermoplastic resin coating layer formed by hot-melt coating at the surface portion thereof. Preferably, the golf ball of the present invention comprises a main body and one or more coating layers formed on the main body, at least one of the coating layers being made of a thermoplastic resin and formed by hot-melt coating.

The present invention also provides a process for producing a golf ball which comprises forming, by hot-melt coating, a coating layer made of a thermoplastic resin on the surface of a main body of a golf ball in which dimples have not been formed, and then forming dimples by compression-molding the coated main body.

As used herein, the term "main body" means a solid core enclosed with a cover in the case of multipiece solid golf balls such as two-piece and three-piece golf balls, a thread-wound core enclosed with a cover in the case of thread-wound golf balls, and a solid core itself in the case of one-piece golf balls.

In the present invention, hot-melt coating is a lining method wherein a hot melt in a molten state established by application of heat is applied onto an object surface, followed by solidification through cooling to form a coating. A hot melt is a material which does not contain water or solvent and is used such that it is melted by application of heat, is applied onto an object surface, and is then cooled to room temperature to be solidified. A hot melt may be applied by extrusion, spraying, a roll coater, dipping, or the like.

Since a coating of a thermoplastic resin formed by hot-melt coating easily deforms by application of heat and pressure, dimples can be formed by application of heat and pressure after the coating is formed. Thus, according to the present invention, precisely shaped, sharp-edged dimples can be formed without lowering of preciseness of the dimple shape which would otherwise result due to coating after formation of dimples, thereby improving travel properties of a golf ball.

In the present invention, by properly selecting a thermoplastic resin to be hot-melt coated and by properly selecting coating thickness to thereby properly choose properties of the coating, the coating layer can be given sufficient durability and functions to improve spin properties and travel properties. That is, since a considerably thick coating layer can be formed through hot-melt coating, the ratio of the volume of the coating layer to the entire volume of the golf ball can be made relatively large. Thus, the properties of the coating layer can favorably influence golf ball spin properties and travel properties, and the coating layer can be given a sufficient durability.

Therefore, according to golf balls and their production process of the present invention, a coating layer at the surface portion of a golf ball allows design values to be reliably reproduced, allows dimples to be precisely shaped and sharp edged, and can be given sufficient durability and functions to improve spin properties and travel properties.

DESCRIPTION OF THE PREFERRED EMBODIMENTS

The present invention will be described in detail below.

In the present invention, a hot melt used for hot-melt coating is composed mainly of a thermoplastic resin. In this case, the type of a thermoplastic resin is not particularly limited. Examples of such a thermoplastic resin include an ionomer resin, polypropylene, polyethylene, an ethylene-vinyl acetate copolymer resin, and thermoplastic polyurethane. Particularly preferred are thermoplastic polyurethane in view of excellent durability of a coating formed thereof, and an ionomer resin in view of excellent moldability for forming dimples.

As a hot-melt coating method, there may preferably be employed an extrusion coating method, particularly an extrusion coating method using a hot-melt applicator such as a hot-melt dispenser, a hot-melt spray, or the like. The employment of extrusion coating will improve the efficiency of a hot-melt coating process. The hot-melt dispenser is a compact piston type extruder for extruding a hot melt in a molten state in the form of a spiral, a line (thick or thin), spray, a film, or the like. The hot-melt dispenser allows a hot melt to be uniformly and easily applied onto the surface of a main body of a golf ball at a certain thickness. The hot-melt dispenser may also facilitate hot-melt coating by extruding a molten hot melt in a film form and wrapping the extruded film-like hot melt around the main body of a golf ball. The hot-melt spray is also a piston type extruder, and has a rotating element at the tip thereof for extruding a molten hot melt in a spray form.

Figure 4:
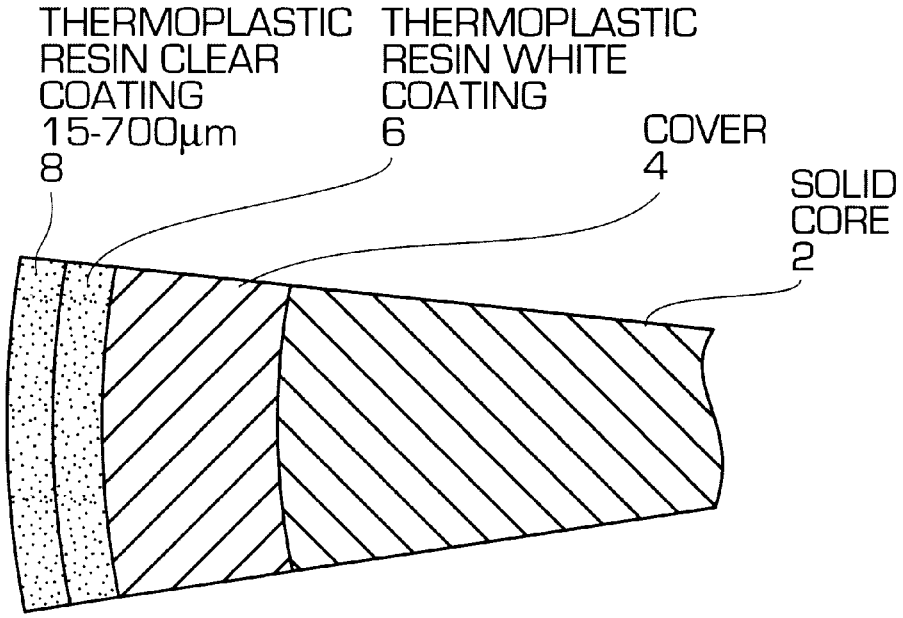
FIG. 4 is a partially enlarged sectional view showing a golf ball according to a further embodiment of the present invention.

The thickness of a thermoplastic resin coating layer formed by hot-melt coating is preferably 15 to 700 $\mu$m, particularly 30 to 500 $\mu$m, most preferably 50 to 200 $\mu$m. When coating thickness is thinner than 15 $\mu$m, durability of the coating may deteriorate. When the thickness exceeds 700 $\mu$m, a uniform coating may be difficult to obtain due to a drool caused by poor cooling after application. When two layers of coating are formed by hot-melt coating (for example, as seen in FIG. 4), the thickness of each coating layer may fall within the above-described ranges.

In conventional coating, to prevent lowering of preciseness of the dimple shape (as already mentioned), the coating thickness is kept very thin at about 10 $\mu$m. This thin coating functions only to protect the golf balls and to improve the appearance. Contrary to this, according to the present invention, by making a thermoplastic resin coating layer formed by hot-melt coating thicker in the range of 15 to 700 $\mu$m, the coating is given sufficient durability and functions to improve spin properties and travel properties as well as functions to protect the golf ball and to improve appearance. A conventional injection molding method cannot form such a thin cover as coating implemented by the present invention.

In the production process of golf balls of the present invention, hot-melt coating is applied to, for example, the following steps, but is not limited thereto.

① In two-piece or three-piece golf balls and thread-wound golf balls, when a coating is applied onto a cover material surface, and then mark stamping is carried out, followed by application of an outermost layer coating of a golf ball, the coating on the cover material surface and/or the outermost layer coating is formed of a thermoplastic resin by hot-melt coating.

② In two-piece or three-piece golf balls and thread-wound golf balls, when a mark is directly stamped onto the bare cover material surface, and then an outermost layer coating of a golf ball is formed, the outermost layer coating is formed of a thermoplastic resin by hot-melt coating.

③ In one-piece golf balls, an outermost layer coating is formed of a thermoplastic resin by hot-melt coating.

When a thermoplastic resin coating formed by hot-melt coating is considered as a thin cover, the above-described two-piece golf ball may be considered as a three-piece golf ball having so thin an outermost cover that cannot be formed by injection molding. Likewise, the above-described one-piece golf ball may be considered as a two-piece golf ball having so thin a cover that cannot be formed by injection molding.

In the present invention, by properly selecting the properties of a thermoplastic resin coating layer formed by hot-melt coating, the coating layer can be given functions to improve spin properties and travel properties. For example, in two-piece or three-piece golf balls and thread-wound golf balls, when an outermost layer coating is formed of a thermoplastic resin by hot-melt coating, and hardness of the coating is made less than that of a cover, golf balls having excellent spin properties can be obtained.

The present invention will be described in detail with reference to the drawings.

Figure 5:
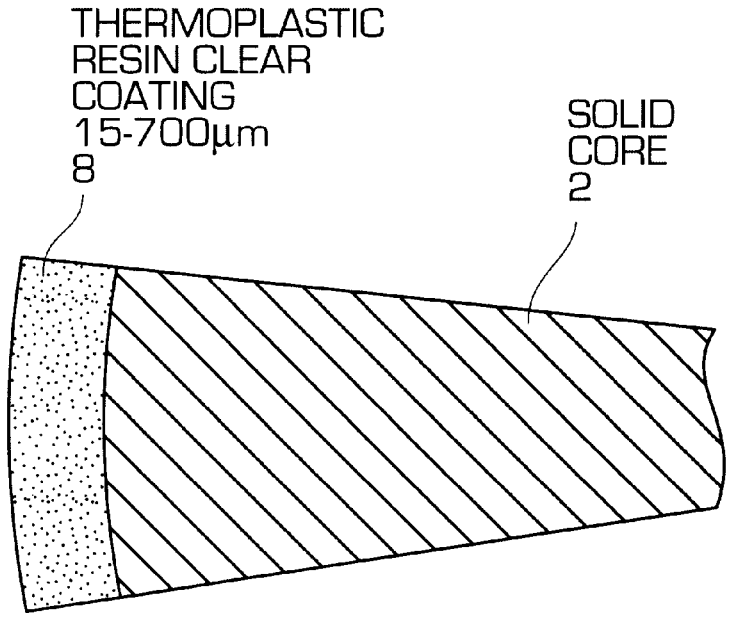
FIG. 5 is a partially enlarged sectional view showing a golf ball according to a further embodiment of the present invention.

FIGS. 1 to 5 are partially enlarged views showing golf balls according to embodiments of the present invention. FIGS. 1 to 4 show embodiments of two-piece golf balls. FIG. 5 shows an embodiment of a one-piece golf ball. Three-piece golf balls and thread-wound golf balls may be constructed in a manner similar to the two-piece golf balls of FIGS. 1 to 4. In addition, a mark to be formed by mark stamping and dimples are not shown in FIGS. 1 to 5.

Figure 1:
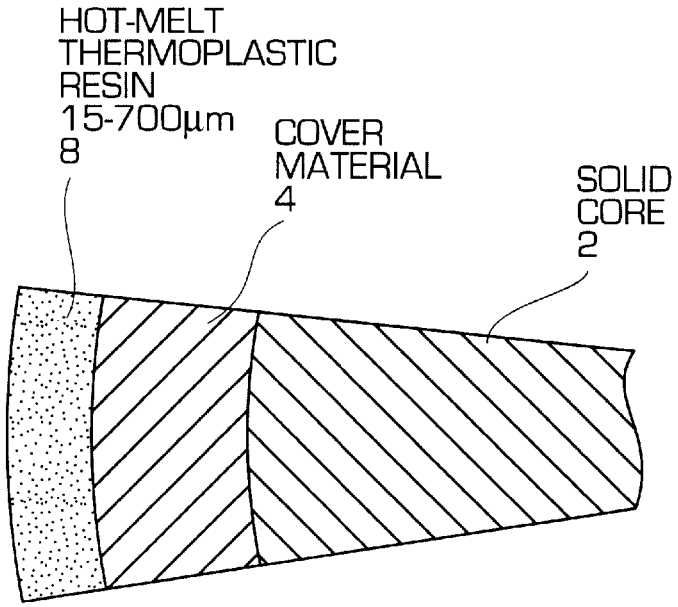
FIG. 1 is a partially enlarged sectional view showing a golf ball according to an embodiment of the present invention.

The two-piece golf ball as shown in FIG. 1 may be prepared by enclosing a solid core 2 with a cover material 4; conducting mark stamping directly on the surface of the cover materials 4; forming, by hot-melt coating, a transparent coating layer 8 made of a thermoplastic resin as an outermost layer; and then conducting dimple processing.

Figure 2:
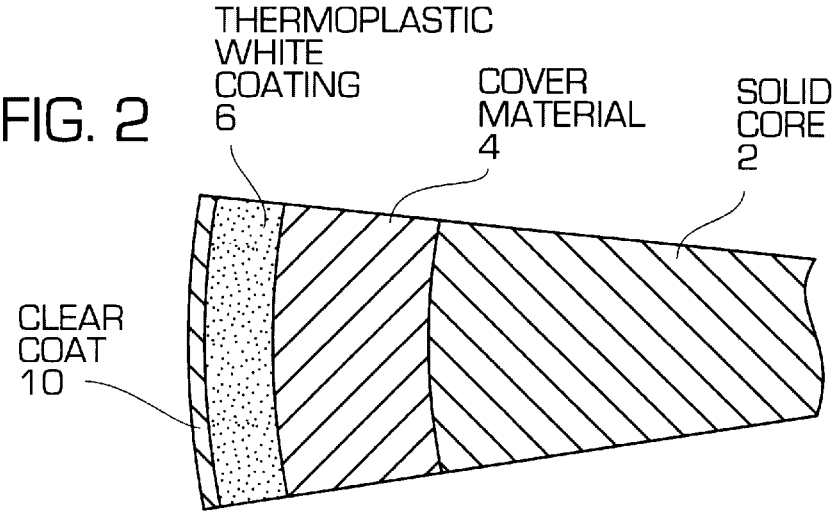
FIG. 2 is a partially enlarged sectional view showing a golf ball according to another embodiment of the present invention.

The two-piece golf ball as shown in FIG. 2 may be prepared by enclosing a solid core 2 with a cover material 4; forming, by hot-melt coating, a white coating layer 6 made of a thermoplastic resin on the surface of the cover material 4; conducting dimple processing through the coating layer 6; conducting mark stamping on the coating-layer 6; and forming a clear, conventional coating 10 as an outermost layer of the ball.

Figure 3:
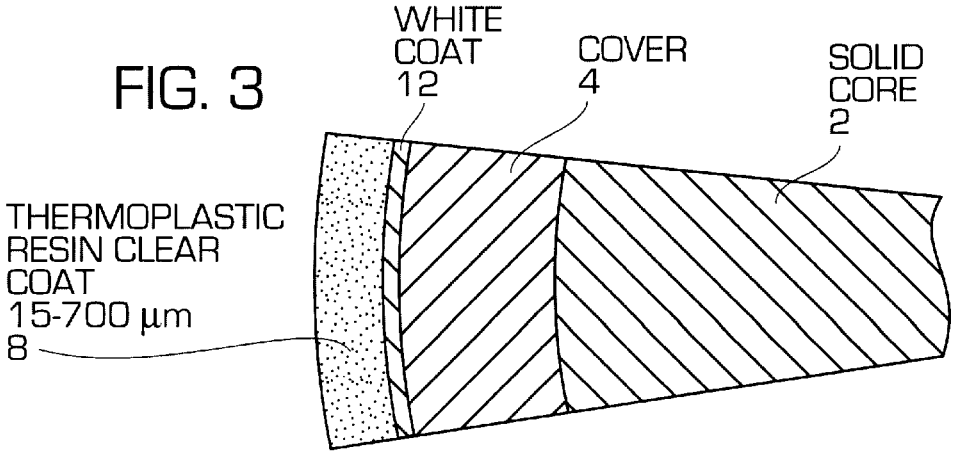
FIG. 3 is a partially enlarged sectional view showing a golf ball according to a further embodiment of the present invention.

The two-piece golf ball as shown in FIG. 3 may be prepared by enclosing a solid core 2 with a cover material 4; forming a conventional white coating layer 12 made of a thermosetting coating material or two-pack system coating material on the surface of the cover material 4; conducting mark stamping on the coating layer 12; forming, by hot-melt coating, a transparent coating layer 8 made of a thermoplastic resin as an outermost layer of the ball; and finally conducting dimple processing.

The two-piece golf ball as shown in FIG. 4 may be prepared by enclosing a solid core 2 with a cover material 4;

forming, by hot-melt coating, a white coating layer 6 made of a thermoplastic resin on the surface of the cover material 4; conducting mark stamping on the coating layer 6; forming, by hot-melt coating, a transparent coating layer 8 made of a thermoplastic resin as an outermost layer of the ball; and finally conducting dimple processing.

The one-piece golf ball as shown in FIG. 5 may be prepared by conducting mark stamping on the surface of a solid core 2; forming, by hot-melt coating, a transparent coating layer 8 made of a thermoplastic resin as an outermost layer of the ball; and finally conducting dimple processing.

EXAMPLES

Two-piece golf balls as indicated in FIG. 1 were prepared in the above-mentioned procedure. As a hot melt to be applied by hot-melt coating, a material comprising an ionomer resin (Surlyn #8120 manufactured by Du Pont, Ltd.) was used. This ionomer resin has a softening point of 49° C. and a melting point of 82° C. The aforementioned hot-melt dispenser was used to carry out hot-melt coating. The hot-melt dispenser used was a hot-melt spray gun (HYSOL 4120) manufactured by The Dexter Corporation (U.S.A.) and soled by Sanyo Boeki Co., Ltd. A hot melt in a molten state was extruded from the hot melt dispenser in the form of a line having a diameter of 1 mm. The thus-extruded hot melt was applied onto the surface of a main body of a golf ball while the main body of a golf ball was being rotated. Subsequently, the applied hot melt was solidified through cooling, followed by the formation of dimples by compression molding.

In the above embodiments, precisely shaped, sharp-edged dimples were obtained, which were as precise and sharp as uncoated dimples of the conventional golf balls which have been just prepared by enclosing a core with a cover material, and then forming dimples thereon.

Further, the spin properties of the golf balls prepared were tested. As a result, the spin quantity given when hit with No. 1 Wood was the same as that given by a conventional low spin type golf ball, resulting in a spin property which can prevent the golf balls from being easily blown up by wind. In addition, the spin quantity given when hit with a pitching wedge was the same as that give by a conventional high spin type golf ball, resulting in a spin property which can easily impart back spin.

According to golf balls and their production process of the present invention, a coating at the surface portion of a golf ball allows design values to be reliably reproduced, allows dimples to be precisely shaped and sharp edged, and can be given sufficient durability and functions to improve spin properties and travel properties.

What is claimed is:

1. A golf ball comprising; a coating layer forming an outermost layer of said golf ball, said coating layer made of a thermoplastic resin and formed by hot-melting coating, through the use of a hot melt dispenser, and wherein the thickness of the coating layer is in the range of 15–700 $\mu$m.

2. A golf ball according to claim 1, wherein dimples are formed after the thermoplastic resin coating layer is formed by hot-melt coating.

3. A golf ball according to claim 1, wherein a thermoplastic resin is selected from an ionomer resin, polypropylene, an ethylene-vinyl acetate copolymer resin, and thermoplastic polyurethane.

4. A golf ball according to claim 1, wherein the golf ball comprises a main body and said coating layer is formed on the main body.

5. A golf ball according to claim 4, wherein the main body is a solid core enclosed with a cover.

6. A golf ball according to claim 4, wherein said main body comprises a thread-wound core enclosed with a cover.

7. A golf ball according to claim 4, wherein said main body consists of a solid core.

8. A golf ball according to claim 4, wherein said main body comprises a solid core enclosed with a cover and a second coating layer disposed over said main body.

9. A golf ball of claim 8, wherein said second coating layer comprises a clear coat over said thermoplastic resin coating layer.

10. A golf ball according to claim 9, wherein said clear layer is made from a thermoplastic resin.

11. A golf ball according to claim 1, wherein said golf ball comprises a main body, a white coating layer formed on said main body and said thermoplastic coating layer formed over said white coating layer.

* * * * *